United States Patent [19]

Waltl et al.

[11] Patent Number: 4,588,020

[45] Date of Patent: May 13, 1986

[54] SURVEILLANCE SYSTEM FOR CURVED CONTINUOUS CASTING PLANTS

[75] Inventors: Josef Waltl, Ostermiething; Fritz Gränitz; Karl Schwaha, both of Linz, all of Austria

[73] Assignee: Voest-Alpine International Corporation, New York, N.Y.

[21] Appl. No.: 567,521

[22] Filed: Jan. 3, 1984

[30] Foreign Application Priority Data

Jan. 11, 1983 [AT] Austria ..... 74/83

[51] Int. Cl.[4] ..... B22D 11/20

[52] U.S. Cl. ..... 164/454; 164/154

[58] Field of Search ..... 164/454, 452, 154, 413, 164/455, 414, 453

[56] References Cited

U.S. PATENT DOCUMENTS

| | | | |
|---|---|---|---|
| 3,358,743 | 12/1967 | Adams . | |
| 3,478,808 | 10/1969 | Adams | 164/454 |
| 3,842,894 | 10/1974 | Southworth | 164/453 |
| 4,317,482 | 3/1982 | Wolf | 164/413 |
| 4,463,795 | 8/1984 | Chielens | 164/414 |

FOREIGN PATENT DOCUMENTS

| | | | |
|---|---|---|---|
| 234294 | 6/1964 | Austria . | |
| 301778 | 7/1969 | Austria . | |
| 0036342 | 2/1981 | European Pat. Off. | 164/414 |

*Primary Examiner*—Nicholas P. Godici
*Assistant Examiner*—G. M. Reid
*Attorney, Agent, or Firm*—Horst M. Kasper

[57] ABSTRACT

A system is provided for limiting the parameters of the motion of a billet in a bow-type continuous casting plant. The stiffness of the billet is determined from values of the motion of the elements of the billet and/or from properties of the advancing billet as picked up by sensing elements. The determined values are compared with preset limiting values for parameters such as the maximum residual withdrawal time, the maximum still permissible stoppage time period and/or the permissible minimum withdrawal speed. If the limiting values are exceeded a signal is provided by a computing provision and fed to an alarm or is used to trigger a shut-off of the continuous casting process.

21 Claims, 3 Drawing Figures

SURVEILLANCE SYSTEM FOR CURVED CONTINUOUS CASTING PLANTS

BACKGROUND OF THE INVENTION

1. Field of the Invention

The invention relates to a method and apparatus for surveillance of a bow-type continuous casting plant, in particular of a steel bow-type continuous casting plant, where a curved strand exiting from the strand guiding provision is straightened in a straightening provision.

2. Brief Description of the Background of the Invention Including Prior Art

Two types of curved continuous casting apparatus are known. One type relates to curved continuous casting plants, where the strand is cast in a curved mold and is straightened in a straightening aggregate after redirection into a horizontal direction. A second type relates to curved continuous casting plants, where the strand is cast in a straight line mold, is redirected in a bending aggregate into a circular curve path and after reaching of a horizontal direction the strand is straightened out in a straigtening provision. A standstill of the strand can occur in each of the two systems based on interruptions of the operation, that is the strand remains standing still for a certain short time in the apparatus until the interruption is eliminated. In addition, it may become necessary to substantially reduce the withdrawal speed of the strand and the casting speed for certain times, for example in cases where it is desired to change the cross-section of the strand without interruption of the continuous casting process. Such standstill or reduction of the withdrawal speed of the strand causes a solidification of the strand inside of the apparatus such that increased directional forces become necessary for bending or, respectively, straightening of the strand based on the increased stiffness of the strand.

In case the strand remains too long in the apparatus, then heavy damages can be caused to the apparatus upon following withdrawal of the excessively cooled strand and in particular the guide rolls and the straightening aggregate can become damaged, and such damage is usually associated with correspondingly long breakdown times and with high costs for repair of the damage.

SUMMARY OF THE INVENTION

1. Purposes of the Invention

It is an object of the present invention to provide a method for surveillance of a curved continuous casting plant, which recognizes early enough the excessive stiffening of a strand and which prevents the withdrawing of a too strongly cooled strand from the apparatus in order to avoid the disadvantages and problems of conventional continuous casting plants.

It is another object of the present invention to prevent an excessively strong cooling of a strand in the range of the curved path of the strand such that damages can be avoided which would result at the apparatus from trying to process a strand which has stiffened too much.

It is a further object of the invention to provide a reliable system for controlling the motion and the cooling cycle of a strand in a bow-type continuous casting plant.

These and other objects and advantages of the present invention will become evident from the description which follows.

2. Brief Description of the Invention

According to one aspect, the present invention provides a method of surveillance of a curved continuous casting plant where a curved strand exiting from a billet guide means is straightened. The strand is cast in a continuous mold. Then the strand is fed through a guiding means. The stiffness of the strand is determined on its path from the mold through the guiding means. The allowable and permissible residual time motion parameters of the strand are determined. A signal is provided upon exceeding of the permissible residual time motion parameters of the strand in order to induce appropriate steps for continuing the casting process.

Preferably, the continuous casting plant is a plant for casting steel. The withdrawal speed of the strand can be employed to determine the stiffness of the strand on its path from the mold to the end of the straightening means.

The residual time motion parameter determined can be the permissible residual withdrawal time and a signal can be provided upon exceeding of the permissible residual withdrawal time based on the current withdrawal speed. The residual time motion parameter determined can also be the permissible minimum withdrawal speed of the strand and a signal can be provided upon passing of the permissible minimum withdrawal speed based on the current withdrawal speed. Further, the residual time motion parameter determined can be the permissible maximum stoppage time period and a signal can be provided upon passing of the permissible maximum stoppage time based on the current withdrawal speed cycle.

The withdrawal speed of the strand can be increased upon the generation of the signal. The continuous casting process can be interrupted upon occurrance of the signal. A value can be coordinated to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed, such that the value determined for each element is compared with a limiting value depending on the actual withdrawal speed (v) and that the minimum positive difference of the positive differences between the limiting values and the determined values is used as a determining factor for the maximum permissible residual withdrawal time.

A value can be coordinated to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed. A permissible limiting value for the stiffness is coordinated to each element depending on the momentary position of the element and the determined level of the stiffness of each element is compared with a corresponding permissible limiting value. The minimum positive difference can be selected from all the positive differences between the limiting values in each case and the determined values and this difference can be employed as a determining factor for the still permissible maximum stoppage time period.

A value can be coordinated to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed, determining a stiffness increase starting with the value determined for each element, which results in a stiffness value on the path of the element from the mold input level to the end of the straightening provision for constant withdrawal speed, which stiffness value is still below all maximum permissible limiting values, and this stiffness increase is employed as a determining factor for a withdrawal speed of each element in each case and the maximum withdrawal speed in determined from these withdrawal speeds as the still permissible minimum withdrawal speed.

The parameters of the cooling conditions can be employed in addition to the withdrawal speed for the determination of the stiffness of each element. The cross-sectional form can be employed in addition to the withdrawal speed for the determination of the stiffness of each element. A physical property of the strand can be employed in addition to the withdrawal speed for the determination of the stiffness of each element. The limiting values employed can be determined from construction conditioned strength values of the strand guide means for obtaining the permissible residual time motion parameters. Strand property parameters can be additionally employed for determining the permissible limiting values.

According to another aspect of the invention, a curved continuous casting plant can comprise a ladle supplying cast metal, a tundish receiving cast metal from the ladle for continuously feeding liquid metal, a continuous casting mold receiving liquid metal from the tundish, a curve-shape inducing means for forming a curved cast metal strand, a straightening means for straightening again the curved strand, a withdrawal provision for moving the cast metal strand formed in the mold, sensing elements determining characteristic conditions of the moving strand, a control unit connected to the withdrawal means of the strand for providing a defined withdrawal speed, and a computing provision connected to the control unit for transmitting speed setting signals to the control unit and connected to a measurement device producing a signal corresponding to the status of the moving strand and providing an output signal if a characteristic of the motion of the strand passes beyond a predetermined permissible parameter.

An alarm unit can be connected to the output signal of the computing provision. A ladle output control element and/or a tundish output control element can be connected to the computing provision to allow for interruption of the flow of liquid metal to the mold upon reaching of a limiting parameter by a characteristic value of the motion of the strand. A device can be provided for sensing a property of the moving strand, and a conduit means can be furnished for feeding a signal from the device for sensing to the computing means for providing an output signal if a characteristic of the advance motion of the strand passes beyond a predetermined permissible parameter.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
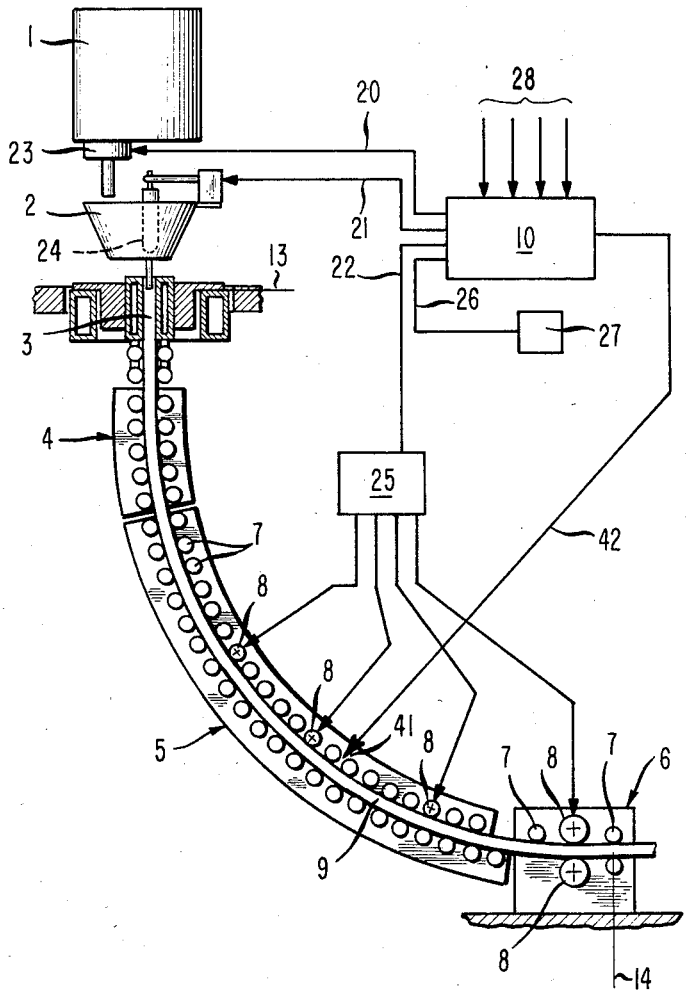
FIG. 1 is a view of a schematic diagram representing a curved continuous casting apparatus and its controls according to the invention.

In accordance with the invention there is provided a method for surveillance of a curved continuous casting plant and in particular of a curved continuous steel casting plant, where a strand 9 exiting from the strand guiding provision 5 is straightened in a straightening aggregate. The still permissible residual withdrawal time or the still permissible maximum stoppage time or the still permissible minimum withdrawal speed ($v_{min}$) of the billet 9 are determined depending on the process parameters such as the strand withdrawal speed influencing the stiffness 15 of the strand 9 on its path from the mold to the end 14 of the straightening aggregate 6. An alarm signal is generated and/or the control of the plant is modified by way of correction upon an exceeding of the residual withdrawal time or, respectively, of the still permissible stoppage time or upon dropping below the minimum withdrawal speed when proceeding with the momentary withdrawal speed with the purpose of either increasing the withdrawal speed or of interrupting the casting process. This means that the events of the strand on its path from the mold to the end of the straightening aggregate, as far as they influence the stiffness of the strand are recorded and the stiffness of the strand is determined from these recorded values without causing a need to perform measurements directly at the advancing strand. Thus the previous history of the production of the strand is employed in the surveillance of the curved continuous casting plant.

Figure 3:
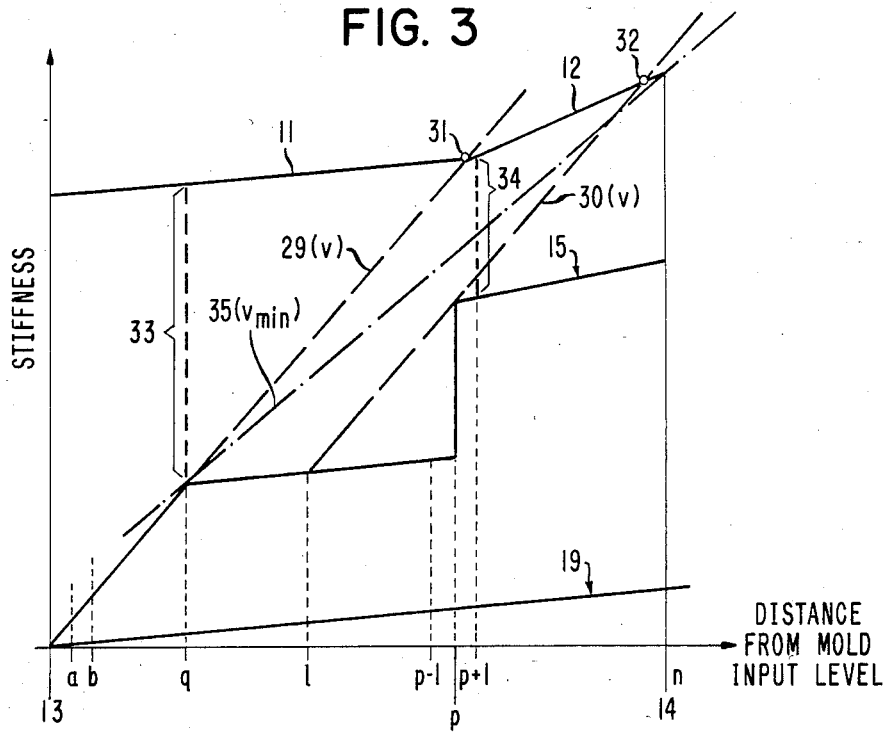
FIG. 3 is a view of a another diagram showing a plot of the stiffness of a strand element versus the distance of the element from the mold input level.

Preferably, a value is assigned to each strand cross-section element (a, b, . . . n) momentarily passing by at a certain distance from the mold input level. The size of the value corresponds about to the stiffness 15 of the element and is determined primarily from the withdrawal speed v of the cross-section element (a, b, c, . . . n) on its path from the mold input level 13 to a certain distance from the mold input level. According to one feature the value thus determined for each element is compared in each case with a permissible limiting value 31, 32, at 11, 12 depending on the actual casting speed v and the minimum difference of the positive differences between the limiting values and the determined values is used as a determining factor for the maximum still permissible withdrawal time. This feature is illustrated in FIG. 3. According to a second feature also illustrated in FIG. 3 a permissible value for the stiffness is coordinated to each element depending on the momentary position taken by the element. The determined value of the stiffness of each element is compared with the corresponding limiting value 11, 12 and the minimum positive difference is selected from all positive differences 33, 34 between the limiting values 11, 12 in each case and the determined values. The minimum positive difference is used as a determining factor for the still permissible stoppage time period. According to a third feature, in each case a stiffness increase is determined taking as a starting point the as above set forth determined value for each element. A stiffness value results from the stiffness increase on the path of the element from its momentary distance from the mold input level to the end 14 of the straightening aggregate 6 upon a constant withdrawal speed, which stiffness value is disposed just below all possible maximum limiting values 11, 12. This stiffness increase is used as a determining factor for a withdrawal speed in each case for each element. The maximum withdrawal speed is determined from these withdrawal speeds as the permissible minimum withdrawal speed $v_{min}$ as illustrated in FIG. 3.

In addition to the withdrawal speed, the cooling conditions, the strand cross-sectional form and/or the properties of the strand can be employed for determining the stiffness of each element. The permissible limiting values 11, 12 used for determining the maximum still permissible residual withdrawal time period or, respectively, of the maximum still permissible stoppage time period or for determining the still permissible minimum withdrawal speed $v_{min}$ are determined depending on the strength values resulting from the construction parameters as well as, if appropriate, in addition on the strand cross-sectional shape and/or the quality of the strand. This takes for example into consideration that individual machine parts of the continuous casting plant are constructed from a more rugged material than other machine parts loaded and subjected to wear by the passing strand. For example, the straightening aggregate is constructed for a substantially higher loading as compared with the bending aggregate if such employed or as the circular arcuate strand guidance provision disposed between these aggregates.

The word strand as employed in the present disclosure comprises various kinds of continuous cast metal products such as for example slabs, rods, strands, and rails.

According to the invention a ladle 1 is disposed above a tundish or intermediate vessel 2 and the steel melt flows from the ladle 1 into the intermediate vessel 2. The steel melt then flows from the intermediate vessel 2 into a water cooled straight mold 3. A bending aggregate 4 is disposed below the mold 3 and a circular arc shaped strand guide provision 5 follows the bending aggregate 4. A straightening aggregate 6 is provided at the end of the strand guide provision extending for about a quarter circle and a run-out roll section with a flame cutting provision follows.

Motor-driven rolls 8 are provided in addition to the rolls 7, which are not connected to a drive mechanism in the circular bow shaped strand guide provision 5 and in the straightening aggregate 6. The driven rolls transport the strand 9 at a predetermined withdrawal speed from the mold. An analog and/or digital computer is designated as 10 in FIG. 1. In addition, sensing elements 41 can be provided, which sense properties of interest of the strand at desired locations. The sensing elements are connected via a conduit 42 to the microcomputer, where the conduit possibly comprises signal shaping elements. The sensing elements can measure for example the bending of the strand, the strength of the strand, frictional effects of the billet surface, light reflection of the strand surface, the interaction of ultrasonic waves with the strand, and/or the magnetic properties of the strand.

Figure 2:
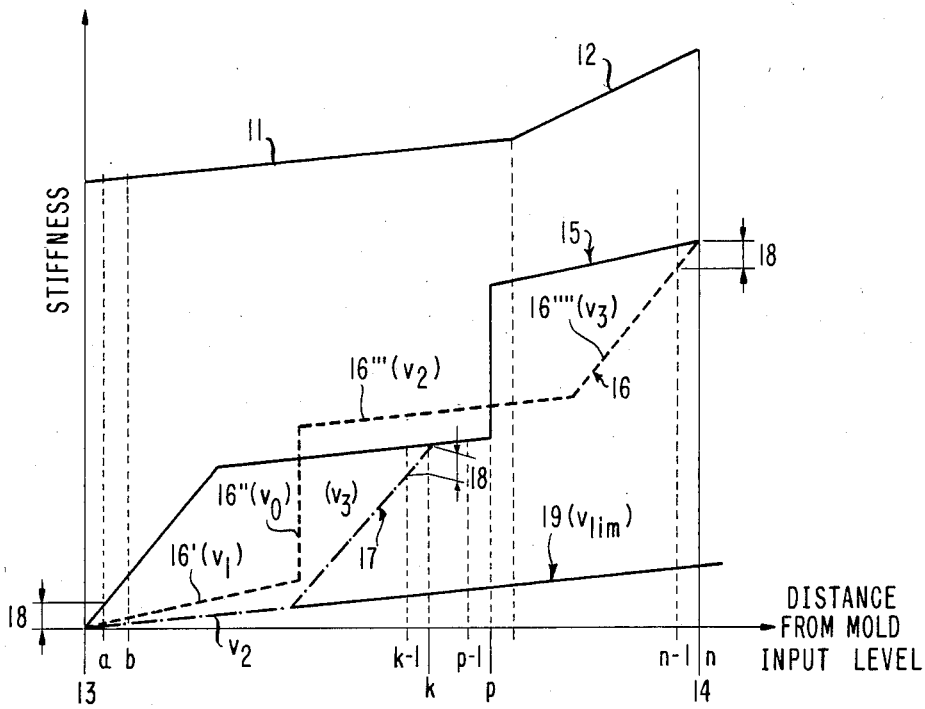
FIG. 2 is a view of a diagram showing a plot of the stiffness of a strand element versus the distance of the element from the mold input level.

The diagram shown in FIG. 2 illustrates the upper limit values for the stiffness of the strand 9 with the straight lines 11, 12, and in fact depending on the distance from the mold input level 13 to the end 14 of the straightening aggregate 6. Not only factors depending on the machine, that is factors caused by the construction of the guiding provision such as stiffness of the rolls 7, 8, loadability of the bearings and the like, but also the setting of the strand cross-section set at the strand continuous casting apparatus and the quality of the steel to be cast are considered for fixing the maximum permissible values 11, 12.

In addition, the stiffness 15 of the strand 9 is illustrated in FIG. 2 as a function depending on the mold input level, as they occur at a certain point in time during the casting process. Thus this function corresponds to the actual course of the stiffness at a certain point in time and thus represents a kind of momentary picture of the stiffness of the strand. This momentary picture of the strand is obtained by subdividing the strand 9 into strand cross-sectional elements, which are designated in FIG. 2 as a to n. A stiffness taking into consideration the previous production history is coordinated to each of these elements, that is a stiffness is coordinated to each strand element based on occurrances which were experienced on the way from the mold input level 13 to the respective position of the element, which can be at most the end position 14 of the straightening aggregate 6. This coordinate takes into consideration possible standstill situations and times of the strand, in each case the previous distribution of speed v as well as possibly changing cooling conditions, for example the cooling agent flow speed and temperature, which is fed to each element on its path from the mold input level 13 to the momentary position of the element in each case. Further, the cross-sectional shape of the strand and/or the strand quality can be taken into consideration. In addition, the temperature of the melt and/or, respectively, the surface properties of the strand can be used for determining the stiffness.

The previous production "history" of the increase in stiffness of the n-th element is plotted in FIG. 2 with the dashed line, where the increase in speed is illustrated depending on the path sections, along which the element n was moved with constant speed, with straight lines 16', 16'', 16''', 16'''' in a good approximation of the actual stiffness increase.

As can be recognized in FIG. 2, the element n was initially withdrawn at a uniform speed $v_1$ (straight line 16') from the mold input level, whereupon a standstill $v_o$ (straight line 16'') of the strand occurred, whereupon the element was again moved at a constant withdrawal speed $v_2$ (straight line 16''', where the speed $v_2$ was larger than the speed $v_1$, as can be seen from the smaller inclination of the straight line 16'''. Finally, the element n and therewith also all other elements of the strand are put out with a heavily reduced withdrawal speed $v_3$, as follows from the stronger inclined straight line 16'''' of the course 16 of the "history" of the n-th element. Further, the history of the K-th element, which agrees with the last part of the "history" of the n-th element, is plotted with dash-dotted lines 17 in FIG. 2.

In addition, the stiffness increase 18 of the n-th element is entered in FIG. 2 upon withdrawal of the strand resulting upon the movement by the distance disposed between the individual elements, that is the n-th element, which was located initially at the position of the element n−1, experienced a stiffness increase 18 during the further withdrawal over the path from the position of the (n−1)-element to the end of the straightening aggregate. Approximately, one can consider that all elements have experienced about the same increase in stiffness 18 during this last withdrawal step, that is, the elements a and k also did so.

The course of the stiffness is represented by a further straight line 19 shown in FIG. 2, as occurs upon a continuous withdrawal of the strand with a continuous casting speed $v_{lim}$ ($=v_2$ according to FIG. 2). This straight line 19 illustrates thus the minimum permissible stiffness. The stiffness increases only slightly for continuous casting speeds larger than $v_{lim}$ based on the increased feeding in of cooling water such that approximately always the same increase in stiffness is assumed for withdrawal speeds larger than $v_{lim}$. The feeding in of cooling water is controlled with a process computer.

In accordance with the invention the stiffness expected for the future time points is determined by calculation based on the actual continuous casting speed for each of the elements, where the time point is reached after the period needed by the element for passing the residual way to the end of the straightening aggregate. This stiffness to be expected is compared with the maximum permissible stiffnesses 11, 12. If a higher stiffness is coordinated to one of the elements on its path still to be covered to the end 14 of the straightening aggregate 6 at any one point as is coordinated to this point of the path based on the limiting curves 11, 12, then either an alarm signal is generated or the control of the plant is engaged for providing corrections. This can be provided for example by increasing the withdrawal speed or by interrupting the casting process.

It can be seen in FIG. 1 that control conduits 20, 21, 22 run from the process computer 10 to a ladle slider 23 for setting or, respectively, closing the same, to a sprue pin or feed control stopper 24 for the purpose of setting or, respectively, shutting off the feed and to a control unit 25 for setting of a defined strand withdrawal speed. A further line 26 leads to an alarm unit 27. The maximum permissible limiting values 11, 12 of the stiffness, the measurement value of the actual continuous casting speed or, respectively, of the withdrawal speed as well as data relating to the steel quality and to the cross-sectional shape of the strand as well as possibly relating to the cooling process are fed to the process computer 10 via input conduits 28.

The calculation of the stiffness of the individual strand elements can be adapted to the actual situation of the continuous casting process based on the actual measurement data collected.

FIG. 3 shows in a graphic way analogous to the graphic way employed in FIG. 2 that for the elements a to l and the element p with the actual withdrawal speed v the sufficiency is no longer determined by entering the stiffness increase, as it is to be expected upon further casting with the actual speed (and which is illustrated with the dashed straight lines 29, 30) plotted into the diagram starting at these elements. It can be recognized that the straight lines 29, 30, which start at the elements a to l and at the element p, result in intersection points with the maximum permissible limiting values 11, 12.

For each element a stiffness increase to be expected in the future upon further casting with the actual withdrawal speed on the path of each element to the end of the straightening aggregate is ascertained for determining the allowed still permissible residual withdrawal time (compare the straight line 29 in FIG. 3, which equals the stiffness increase for the elements a to q). The withdrawal times required in order to pass from the actual stiffness to the collision (intersection) point on the Fig. are determined from the differences between the limiting value (collision point) and the actual stiffness value for all elements, where a collision (illustrated in FIG. 3 for example for the elements a to q by way of point 31 and for the elements l and p by way of point 32) occurs between the stiffness values to be expected with the limiting values 11, 12. The minimum withdrawal time is selected from these withdrawal times and it represents the allowed still permissible residual withdrawal time period of the strand at the point in time corresponding to the calculation.

In order to determine the still permissible maximum standstill time periods, the differences are formed between the actual stiffness values of the elements a to n and the momentary local corresponding limiting values 11, 12 and the minimum difference is selected from these differences. For example, one of these differences is designated in FIG. 3 as 33 for the element q. The minimal difference is a basis for the calculation of the still permissible maximum stoppage time period. The minimum difference 34 for the element p+1 is provided in FIGS. 2 and 3, that is the element p+1 is responsible for the still permissible maximum stoppage time period.

It is further possible with the process computer to determine the future allowable minimum permissible strand withdrawal speed $v_{min}$ by determining for all elements a to n−1 those withdrawal speeds, which result in stiffness values for these elements on their path to the end 14 of the straightening aggregate 6, which are just below the maximum permissible limiting values 11, 12, and to select from these calculated withdrawal speeds the maximum withdrawal speed.

The stiffness increase (dash-dotted line 35) resulting upon casting with minimum permissible withdrawal speed $v_{min}$ for the element q is shown in FIG. 3. This element q represents the critical element for the momentary picture of the stiffness values illustrated in FIG. 3, that is the minimum withdrawal speed $v_{min}$ has to be set according to this element, since all other elements would permit a lower withdrawal speed and thus a higher specific increase in stiffness.

As can be recognized in each case different limit values of the straight lines 11 and 12 representing the maximum permissible stiffness values are selected for the determination of the still permissible maximum standstill time period, and of the still permissible minimum withdrawal speed, and in fact the intersection points (for example 31, 32) with the extensions of the straight lines (for example 29, 30) representing the stiffness increase upon continued casting at the actual casting speed v are selected for the determination of the still permissible residual withdrawal time. The intersection points resulting from the intersection of the straight lines (e.g. 33, 34) parallel to the ordinate of the FIGS. 2 and 3 are employed for determining the maximum permissible standstill time period of the strand. Finally the values of the straight lines, at which the tangents (for example the straight line) are aligned to the trains of straight lines 11, 12 starting with the actual stiffness values, are employed for determining the still permissible minimum withdrawal speed.

If the cooling process of the strand is also taken into consideration for determining the permissible maximum residual withdrawal time period and the permissible minimum withdrawal time, then corresponding curves take the place of the straight lines 29, 30, and 35.

A further advantage of the invention system results, since a statistical analysis relating to the loading of the continuous casting plant or, respectively, of the elements of the strand guide provision can be generated based on the stiffness values reached by the individual elements a to n in the individual zones of the strand guiding provision or, respectively, of the occurring maximum stiffness values. The statistical analysis is useful for determining the service intervals of the plant.

It will be understood that each of the elements described above, or two or more together, may also find a useful application in other types of continuous casting system configurations and metallic melt freezing procedures differing from the types described above.

While the invention has been illustrated and described as embodied in the context of a surveillance system for curved continuous casting plants, it is not intended to be limited to the details shown, since various modifications and structural changes may be made without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for surveillance of a curved continuous casting plant where a curved strand exiting from a strand guide means is straightened comprising casting the strand in a continuous mold;

feeding the strand through a guiding means;

determining the stiffness of the strand on its path from the mold through the guiding means;

determining the allowable and permissible residual time motion parameters of the strand;

providing a signal upon exceeding of the permissible residual time motion parameters of the strand to induce appropriate steps for continuing the casting process; and coordinating a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed, such that the value determined for each element is compared with a limiting value depending on the actual withdrawal speed (v) and that the minimum positive difference from the positive differences between the limiting values and the determined values is used as a determining factor for the maximum permissible residual withdrawal time.

2. The method for surveillance of a curved continuous casting plant according to claim 1 further comprising employing the parameters of the cooling conditions in addition to the withdrawal speed for the determination of the stiffness of each element.

3. The method for surveillance of a curved continuous casting plant according to claim 1 further comprising employing the cross-sectional form in addition to the withdrawal speed for the determination of the stiffness of each element.

4. The method for surveillance of a curved continuous casting plant according to claim 1 further comprising employing a physical property of the strand in addition to the withdrawal speed for the determination of the stiffness of each element.

5. The method for surveillance of a curved continuous casting plant according to claim 1 further comprising determining the limiting values employed for the determination of the permissible residual time motion parameters from construction conditioned strength values of the strand guide means.

6. The method for surveillance of a curved continuous casting plant according to claim 5 further comprising additionally employing strand property parameters for determining the permissible limiting values.

7. A method for surveillance of a curved continuous casting plant where a curved strand exiting from a strand guide means is straightened comprising casting the strand in a continuous mold;

feeding the strand through a guiding means;

determining the stiffness of the strand on its path from the mold through the guiding means;

determining the allowable and permissible residual time motion parameters of the strand;

providing a signal upon exceeding of the permissible residual time motion parameters of the strand to induce appropriate steps for continuing the casting process; and coordinating a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed; coordinating a permissible limiting value for the stiffness to each element depending on the momentary position of the element; comparing the determined level of the stiffness of each element with a corresponding permissible limiting value; selecting the minimum positive difference from all the positive differences between the limiting values in each case and the determined values; and employing this difference as a determining factor for the still permissible maximum stoppage time period.

8. The method for surveillance of a curved continuous casting plant according to claim 7 further comprising employing the parameters of the cooling conditions in addition to the withdrawal speed for the determination of the stiffness of each element.

9. The method for surveillance of a curved continuous casting plant according to claim 7 further comprising employing the cross-sectional form in addition to the withdrawal speed for the determination of the stiffness of each element.

10. The method for surveillance of a curved continuous casting plant according to claim 7 further comprising employing a physical property of the strand in addition to the withdrawal speed for the determination of the stiffness of each element.

11. The method for surveillance of a curved continuous casting plant according to claim 7 further comprising determining the limiting values employed for the determination of the permissible residual time motion parameters from construction conditioned strength values of the strand guide means.

12. The method for surveillance of a curved continuous casting plant according to claim 10 further comprising additionally employing strand property parameters for determining the permissible limiting values.

13. A method for surveillance of a curved continuous casting plant where a curved strand exiting from a strand guide means is straightened comprising casting the strand in a continuous mold;

feeding the strand through a guiding means;

determining the stiffness of the strand on its path from the mold through the guiding means;

determining the allowable and permissible residual time motion parameters of the strand;

providing a signal upon exceeding of the permissible residual time motion parameters of the strand to induce appropriate steps for continuing the casting process; and coordinating a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed; determining a stiffness increase starting with the value determined for each element, which results in a stiffness value on the path of the element from the mold input level to the end of the straightening provision for constant withdrawal speed, which stiffness value is still below all maximum permissible limiting values; employing this stiffness increase as a determining factor for a withdrawal speed of each element in each case; and determining the maximum withdrawal speed from these withdrawal speeds as the still permissible minimum withdrawal speed.

14. The method for surveillance of a curved continuous casting plant according to claim 13 further comprising employing the parameters of the cooling conditions in addition to the withdrawal speed for the determination of the stiffness of each element.

15. The method for surveillance of a curved continuous casting plant according to claim 13 further comprising employing the cross-sectional form in addition to the withdrawal speed for the determination of the stiffness of each element.

16. The method for surveillance of a curved continuous casting plant according to claim 13 further comprising employing a physical property of the strand in addition to the withdrawal speed for the determination of the stiffness of each element.

17. The method for surveillance of a curved continuous casting plant according to claim 13 further comprising determining the limiting values employed for the determination of the permissible residual time motion parameters from construction conditioned strength values of the strand guide means.

18. The method for surveillance of a curved continuous casting plant according to claim 33 further comprising additionally employing strand property parameters for determining the permissible limiting values.

19. A curved continuous casting plant comprising a ladle supplying cast metal;

a tundish receiving cast metal from the ladle for continuously feeding liquid metal;

a continuous casting mold receiving liquid metal from the tundish;

a curve-shape inducing means for forming a curved cast metal strand;

a straightening means for straightening again the curved strand;

a withdrawal means for moving the cast metal strand formed in the mold;

a sensing element determining characteristic conditions of the moving strand;

a control unit connected to the withdrawal means of the strand for providing a defined withdrawal speed; and a computing means connected to the control unit for transmitting speed setting signals to the control unit and connected to the sensing element producing a signal corresponding to the status of the moving strand and providing an output signal if a characteristic of the advancing motion of the strand passes beyond a predetermined permissible parameter for increasing the withdrawal speed of the strand or for interrupting the continuous casting process depending on the signal respective;

wherein the computer means coordinates a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed, such that the value determined for each element is compared with a limiting value depending on the actual withdrawal speed (v) and that the minimum positive difference from the positive differences between the limiting values and the determined values is used as a determining factor for the maximum permissible residual withdrawal time.

20. A curved continuous casting plant comprising a ladle supplying cast metal;

a tundish receiving cast metal from the ladle for continuously feeding liquid metal;

a continuous casting mold receiving liquid metal from the tundish;

a curve-shape inducing means for forming a curved cast metal strand;

a straightening means for straightening again the curved strand;

a withdrawal means for moving the cast metal strand formed in the mold;

a sensing element determining characteristic conditions of the moving strand;

a control unit connected to the withdrawal means of the strand for providing a defined withdrawal speed; and a computing means connected to the control unit for transmitting speed setting signals to the control unit and connected to the sensing element producing a signal corresponding to the status of the moving strand and providing an output signal if a characteristic of the advancing motion of the strand passes beyond a predetermined permissible parameter for increasing the withdrawal speed of the strand or for interrupting the continuous casting process depending on the signal respective;

wherein the computer means coordinates a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed and where a permissible limiting value for the stiffness is coordinated to each element depending on the momentary position of the element and where the determined level of the stiffness of each element is compared with a corresponding permissible limiting value; selecting the minimum positive difference from all the positive differences between the limiting values in each case and the determined values; and employing this difference as a determining factor for the still permissible maximum stoppage time period.

21. A curved continuous casting plant comprising a ladle supplying cast metal;

a tundish receiving cast metal from the ladle for continuously feeding liquid metal;

a continuous casting mold receiving liquid metal from the tundish;

a curve-shape inducing means for forming a curved cast metal strand;

a straightening means for straightening again the curved strand;

a withdrawal means for moving the cast metal strand formed in the mold;

a sensing element determining characteristic conditions of the moving strand;

a control unit connected to the withdrawal means of the strand for providing a defined withdrawal speed; and a computing means connected to the control unit for transmitting speed setting signals to the control unit and connected to the sensing element producing a signal corresponding to the status of the moving strand and providing an output signal if a characteristic of the advancing motion of the strand passes beyond a predetermined permissible parameter for increasing the withdrawal speed of the strand or for interrupting the continuous casting process depending on the signal respective;

wherein the computer means coordinates a value to each strand cross-sectional element (a, b, . . . n) momentarily passing by at a certain distance from the mold input level, which value about corresponds to the magnitude of the stiffness of the element and for the determination of which primarily the withdrawal speed of the cross-sectional element (a, b, . . . n) on its path from the mold input level to a certain distance from the mold input level is employed and where a stiffness increase is determined starting with the value determined for each element, which results in a stiffness value on the path of the element from the mold input level to the end of the straightening provision for constant withdrawal speed, which stiffness value is still below all maximum permissible limiting values and where this stiffness increase is employed as a determining factor for a withdrawal speed of each element in each case and where the maximum withdrawal speed is determined from these withdrawal speeds as the still permissible minimum withdrawal speed.

* * * * *